US009096969B2

(12) United States Patent
Moon et al.

(10) Patent No.: US 9,096,969 B2
(45) **Date of Patent: *Aug. 4, 2015**

(54) CLOTHES TREATING APPARATUS WITH MOISTURE SUPPLY UNITS

(75) Inventors: Jung Wook Moon, Changwon-si (KR); Dae Yun Park, Changwon-si (KR); Sog Kie Hong, Changwon-si (KR); Jong Seok Kim, Changwon-si (KR); Seung Gyu Ryu, Changwon-si (KR); Hye Yong Park, Changwon-si (KR); Chang Gyu Choi, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1332 days.

This patent is subject to a terminal disclaimer.

(21) Appl. No.: 12/733,069

(22) PCT Filed: Aug. 4, 2008

(86) PCT No.: PCT/KR2008/004499

§ 371 (c)(1),
(2), (4) Date: Oct. 12, 2010

(87) PCT Pub. No.: WO2009/020312

PCT Pub. Date: Feb. 12, 2009

(65) Prior Publication Data

US 2011/0016930 A1 Jan. 27, 2011

(30) Foreign Application Priority Data

Aug. 6, 2007 (KR) ..... 10-2007-0078394

(51) Int. Cl.
*D06F 58/10* (2006.01)
*D06F 58/20* (2006.01)

(52) U.S. Cl.
CPC ..... *D06F 58/10* (2013.01); *D06F 58/203* (2013.01)

(58) Field of Classification Search
CPC ..... D06F 73/02; D06F 58/10; D06F 39/008; D06F 73/00; D06F 81/08
USPC ..... 68/5 C, 205 R, 6; 38/2, 3, 6, 7, 12, 14, 38/71, 72, 103, 141, 142; 34/151, 219, 77, 34/440, 621, 622; 126/369, 361, 374, 126/34.8; 223/51, 52, 66, 67, 68, 70, 77, 223/85, 92, 57; 219/254, 521, 385, 533
See application file for complete search history.

(56) References Cited

U.S. PATENT DOCUMENTS 2,319,434 A * 5/1943 Pungor ..... 223/67
2,562,956 A * 8/1951 Shaw ..... 223/70

(Continued)

FOREIGN PATENT DOCUMENTS

CN 1037557 A 11/1989
CN 2189618 Y 2/1995

(Continued)

*Primary Examiner* — Michael Barr
*Assistant Examiner* — Irina Graf
(74) *Attorney, Agent, or Firm* — McKenna Long & Aldridge LLP

(57) ABSTRACT

Disclosed is a clothes treating apparatus, which treats clothes into a more wearable condition. The clothes treating apparatus includes a cabinet; an accommodating space formed in the cabinet and accommodating clothes; a moisture supplying device generating moisture to be supplied into the accommodating space; and a supply unit discharging the moisture generated by the moisture supplying device into the accommodating space and installed on a bottom of the accommodating space.

10 Claims, 4 Drawing Sheets

(56) References Cited

U.S. PATENT DOCUMENTS

| | | | | | |
|---|---|---|---|---|---|
| 3,672,188 | A | * | 6/1972 | Geschka et al. | 68/12.15 |
| 3,752,373 | A | * | 8/1973 | Smith | 223/51 |
| 4,479,315 | A | * | 10/1984 | Frushtick | 38/42 |
| 4,761,305 | A | * | 8/1988 | Ochiai | 427/180 |
| 4,761,896 | A | * | 8/1988 | Miyata | 34/77 |
| 5,815,961 | A | * | 10/1998 | Estes et al. | 38/14 |
| 8,915,102 | B2 | * | 12/2014 | Moon et al. | 68/5 C |
| 2004/0163184 | A1 | * | 8/2004 | Waldron et al. | 8/149.1 |
| 2005/0115120 | A1 | * | 6/2005 | Cevik | 38/14 |

FOREIGN PATENT DOCUMENTS

| | | | | | |
|---|---|---|---|---|---|
| CN | 1813092 | A | | 8/2006 | |
| DE | 24 33 909 | A1 | | 2/1976 | |
| DE | 603 01 789 | T2 | | 5/2006 | |
| EP | 0 324 589 | | | 7/1989 | |
| EP | 1 491 677 | | | 12/2004 | |
| EP | 1 491 677 | A1 | | 12/2004 | |
| KR | 10-2006-0035385 | | | 4/2006 | |
| KR | 10-0740836 | | | 6/2007 | |
| WO | WO-8301186 | | * | 4/1983 | A47L 15/14 |
| WO | WO2006-091057 | A1 | | 8/2006 | |

* cited by examiner

CLOTHES TREATING APPARATUS WITH MOISTURE SUPPLY UNITS

This application is a National Stage Entry of International Application No. PCT/KR2008/004499, filed on Aug. 4, 2008, and claims priority to Korean Patent Application No. 10-2007-0078394, filed Aug. 6, 2007, both of which are hereby incorporated by reference in its entirety as if fully set forth herein.

TECHNICAL FIELD

The present invention relates to an apparatus, which treats clothes into a more wearable condition, and more particularly, to an apparatus, which uses moisture to treat clothes.

BACKGROUND ART

Generally, a clothes treating apparatus is an apparatus, which treats clothes into a more wearable state. The clothes treating apparatus fundamentally dries clothes and further removes wrinkles, odors, bacteria, and static electricity from the clothes.

In order to perform the above functions, the clothes treating apparatus uses dry and hot air and moisture to treat the clothes. In case that the clothes treating apparatus uses moisture to treat clothes, it is important to spray the moisture uniformly onto the clothes to more effectively treat the clothes.

DISCLOSURE OF INVENTION

Technical Problem

The present invention has been contemplated in view of the above-mentioned problem, and an object of the present invention is to provide a clothes treating apparatus, which sprays moisture uniformly onto clothes.

Technical Solution

The objects of the present invention can be achieved by providing a clothes treating apparatus including a cabinet; an accommodating space formed in the cabinet, and accommodating clothes; a moisture supplying device generating moisture to be supplied into the accommodating space; and a supply unit discharging the moisture generated by the moisture supplying device into the accommodating space, and installed on a bottom of the accommodating space.

The supply unit may be disposed at an edge of the bottom of the accommodating space. In this case, the supply unit could be disposed at a rear, front, or side portion of the bottom of the accommodating space. Further, the supply unit may be provided at a rear or front corner of the bottom of the accommodating space.

The supply unit may be oriented to a central portion of the bottom of the accommodating space, and be oriented to be inclined upward.

A plurality of the supply units may be disposed along the edge of the bottom of the accommodating space.

Alternatively, the supply unit may be installed at a central portion of the bottom of the accommodating space, and be oriented to be substantially vertical to the bottom of the accommodating space.

A plurality of the supply units may be disposed at the central portion of the bottom of the accommodating space, and be connected to a single manifold connected to the moisture supplying device.

The supply unit may comprise a nozzle or a pipe, which is not protruded from the bottom of the accommodating space.

The moisture supplying device may include a pressurizing unit applying a predetermined pressure to the supplied moisture.

The moisture supplying device may include a water tank to store water, a heater installed in the water tank to heat water into steam, and a connection pipe to connect the water tank and the supply unit. Further, the connection pipe may be made of a synthetic resin or rubber. Moreover, the moisture supplying device may be installed adjacent to the bottom of the accommodating space to be located close to the supply unit.

The clothes treating apparatus may further include an air supplying device supplying dry air into the accommodating space.

Advantageous Effects

The above-described clothes treating apparatus effectively treats clothes by using moisture, which is uniformly diffused and distributed.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Now, a clothes treating apparatus in accordance with one preferred embodiment of the present invention will be described in detail with reference to the annexed drawings.

Figure 1:
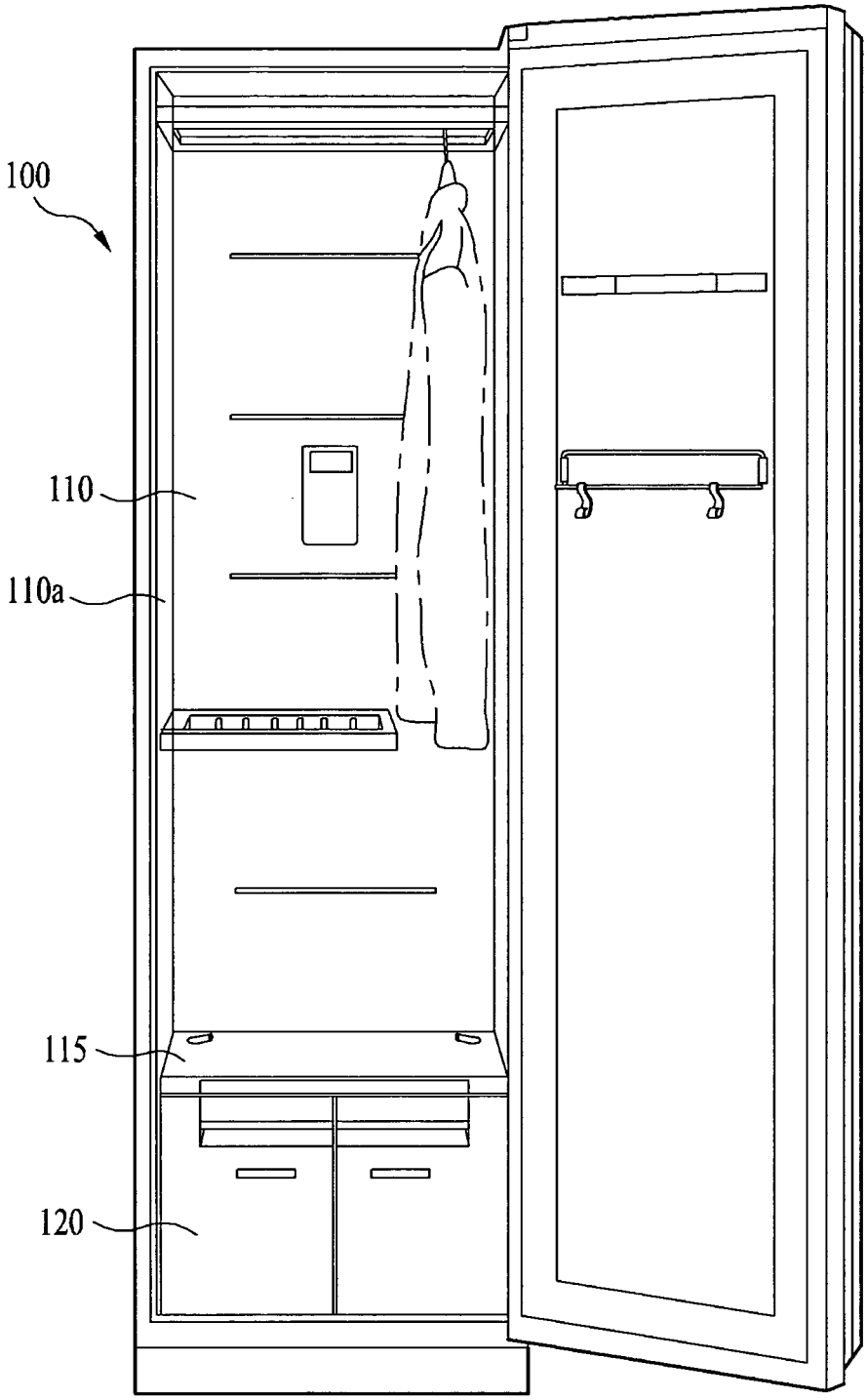
FIG. 1 is a front view illustrating a clothes treating apparatus in accordance with the present invention.
Figure 2:
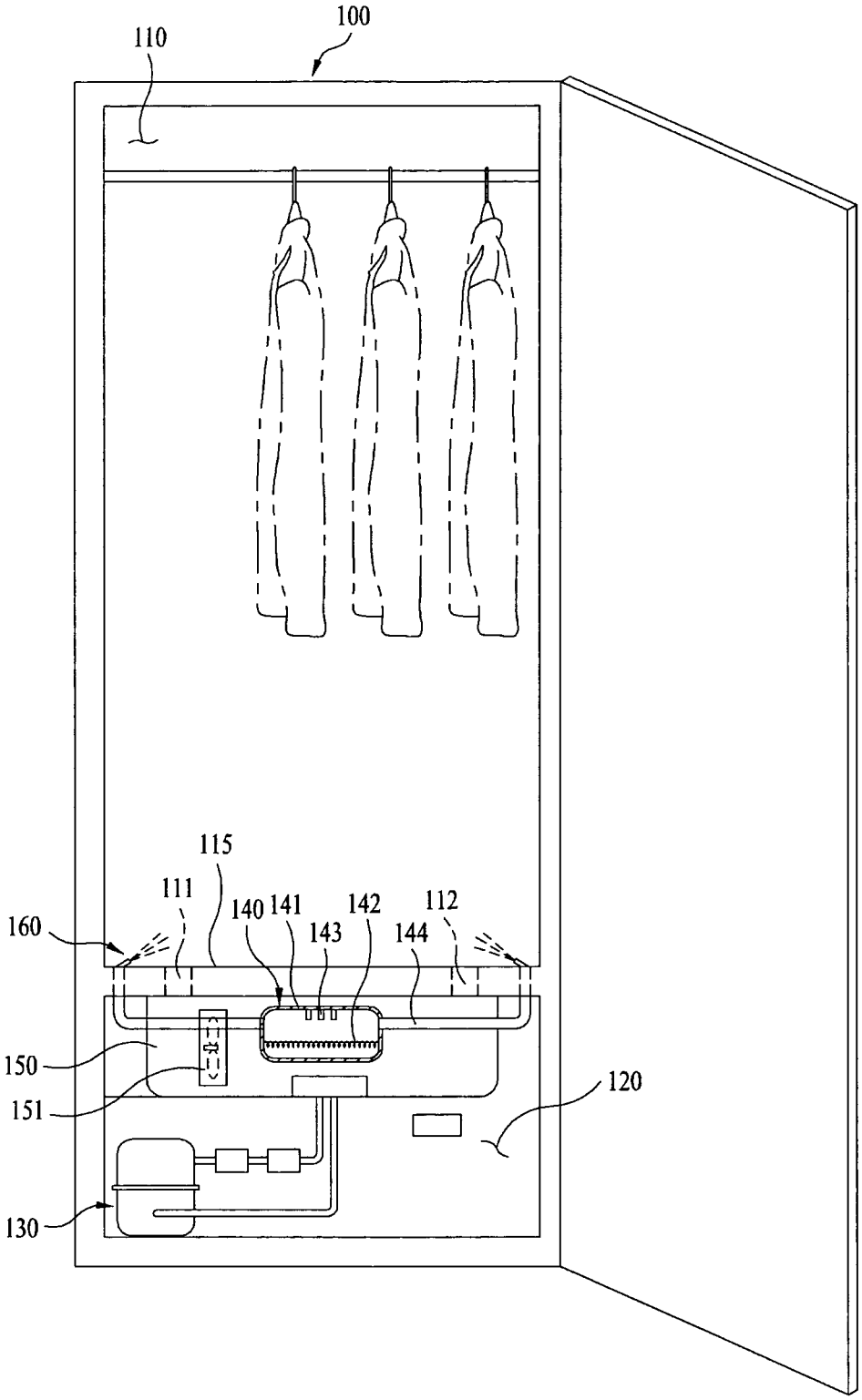
FIG. 2 is a schematic view illustrating the internal configuration of the clothes treating apparatus.

FIG. 1 is a front view illustrating a clothes treating apparatus in accordance with the present invention, and FIG. 2 is a schematic view illustrating devices installed in a device chamber of the clothes treating apparatus of FIG. 1.

As shown in FIGS. 1 and 2, the clothes treating apparatus of the present invention includes a cabinet 100 forming the overall external appearance of the apparatus. An accommodating space 110, which accommodates clothes, is defined in the upper portion of the inside of the cabinet 100, and a device chamber 120 is defined in the lower portion of the inside of the cabinet 100. As shown in FIG. 1, the accommodating space 110 could be formed in an inner cabinet 110*a* separately provided in the cabinet 100. The inner cabinet 110*a* is fixed to the cabinet 100, and thus remains stationary. Like the inner cabinet 110*a*, the accommodating space 110 does not move and thereby maintains the stationary state. The accommodating space 110 has an entrance formed at the front portion thereof, and a user easily puts clothes into the accommodating space 110 through the entrance. The accommodating space 110 is selectively opened and closed by a door rotatably installed on the cabinet 100. Further, various switches (not shown) to operate the clothes treating apparatus are provided on the external surface of the door or the cabinet 100.

The device chamber 120 accommodates various devices required to treat clothes in the accommodating space 110. The device chamber 120 is separated from the accommodating space 110 by a partition 115 forming the bottom of the accommodating space 110. The partition 115 may be provided in the cabinet 100 separately from the inner cabinet 110*a*, or be replaced with the bottom of the inner cabinet 110*a*.

As shown in FIG. 2, the device chamber 120 accommodates an air supplying device 130 and a moisture supplying device 140 among other various devices. The air supplying device 130 fundamentally provides dry air to the inside of the accommodating space 110 to dry clothes. Further, the air supplying device 130 heats the air to provide hot and dry air. Since hot air generally rises upwardly, it is advantageous for the supply of the hot and dry air to install the air supplying device 130 in the lower portion of the inside of the cabinet 100, i.e., at a position below the accommodating space 110, as shown in FIG. 2. The moisture supplying device 140 generates moisture, and selectively supplies the generated moisture into the accommodating space 110. In order to supply the moisture into the accommodating space 110, the moisture supplying device 140 may use mist consisting of fine drops of water, which is moisture in a liquid state, or steam, which is moisture in a gas state. Hereinafter, the moisture supplying device 140 using steam will be described. However, the moisture supplying device 140 using mist could be applied to the clothes treating apparatus for the same purpose. The steam has a high temperature, and thus has a tendency to move upwardly the same as the hot air does. Thus, the moisture supplying device 140 using the steam is preferably disposed below the accommodating space 110. Further, since the air and moisture supplying devices 130 and 140 are separated from the accommodating space 110 by the partition 115, the partition 115 prevents the clothes from being damaged by the heated air and moisture supplying devices 130 and 140, and prevents the clothes from being wet with condensed water generated from the air and moisture supplying devices 130 and 140.

As described above, the air supplying device 130 supplies dry and hot air, and thus dries the clothes in the accommodating space 110. Thereby, the treated clothes are refreshed into a good wearable condition. The moisture generated by the moisture supplying device 140 is supplied to the inside of the accommodating space 110. The moisture removes wrinkles and static electricity from the clothes. Further, the steam of a high temperature removes bacteria and odors from the clothes. Thus, the supplied moisture also refreshes the clothes into a good wearable state.

The air supplying device 130 includes a heater or a thermoelectric element generating hot air, and a dehumidifier provided separately from this heating element. However, the air supplying device 130 preferably uses a heat pump, which performs dehumidification and heating of air simultaneously. FIG. 2 illustrates the air supplying device 130, which uses a heat pump using a refrigeration cycle.

Although not shown in detail, the air supplying device 130, i.e., the heat pump, includes an evaporator, a compressor, a condenser, and an expansion valve, through which a refrigerant circulates. In this case, as a refrigerant in the evaporator is evaporated, the refrigerant absorbs latent heat of surrounding air and thus cools the air. Due the cooling of the air, moisture in the air is removed by condensation. Further, when the refrigerant is compressed by the compressor and then condensed by the condenser, the refrigerant emits latent heat toward the surrounding air and thus heats the surrounding air. Thus, the evaporator and the condenser serve as heat exchangers, and air flowing into the air supplying device 130 is changed into dry and hot air through the evaporator and the condenser.

The air, heated by the heat pump, may have a slightly lower temperature than air heated by a conventional heater, but is dehumidified without using an additional dehumidifier. Thus, the air generated by the air supplying device 130 effectively dries the clothes in the accommodating space 110 such that the clothes are refreshed into a good wearable state.

More specifically, a supply duct 150 is installed to circulate the dry air generated by the air generating device 130, in the accommodating space 110. An inlet 111 is formed through one side of the bottom of the accommodating space 110, i.e., the partition 115, and the air in the accommodating space 110 is flown into the supply dirt 150 through the inlet 111. In case that the air supplying device 130 is located at the outside of the dirt 150, the air flown into the supply duct 150 is discharged from the supply dirt 150 to the air supplying device 130, and is changed into dry air in the air supplying device 130. The generated dry air is supplied again to the supply dirt 150. However, in order to effectively generate and supply dry air, the components of the air supplying device 130 for substantially generating dry air, i.e., the evaporator and condenser, may be disposed in the duct 150. In this case, the air flown into the dirt 150 through the inlet 111 is changed directly into dry air by the evaporator and the condenser in the duct 150. Further, an cutlet 112 is formed through the other side of the bottom of the accommodating space 110, and the dry air is discharged to the accommodating space 110 through the cutlet 112. A blowing fan 151 is installed between the inlet 111 and the cutlet 112 to transfer the dry air.

The moisture supplying device 140 includes a water tank 141 storing water, and a heater 142 installed in the water tank 141 to heat water, as shown in FIG. 2. The moisture supplying device 140 further includes a sensing unit 143 to sense a water level in the moisture supplying device 140. Steam, i.e., moisture, generated by the moisture supplying device 140 is discharged to the inside of the accommodating space 110 by a supply unit 160. Thus, the moisture supplying device 140 further includes a connection pipe 144 to connect the supply units 160 and the water tank 141 to primarily transfer the moisture generated from the water tank 141 to the supply units 160. Further, an external tap is directly connected to the water tank 141, or a user fills the water tank 141 with water whenever water is required. Further, the moisture supplying device 140 may include a pressurizing unit (not shown) to apply a predetermined pressure to the generated moisture. For example, the pressurizing unit could be an air compressor, which compresses air to generate a predetermined pressure. When the compressed air is supplied to the water tank 141, the supply pipe 144, or the supply units 160, the moisture is discharged far and widely into the inside of the accommodating space 110 the to the given pressure, and thus effectively refreshes clothes. In addition to the above-described compressor, the pressurizing unit may be any one of other various devices, which can generate the pressure.

A time to supply moisture is properly adjustable. If the moisture is supplied and then dry air is supplied to the accommodating space 110, the clothes in the accommodating space 110 could be completely dried such that any moisture is not left over in the clothes. For this reason, the moisture is preferably supplied into the accommodating space 110 before the dry and hot air from the air supplying device 130 is supplied into the accommodating space 110.

Figure 3:
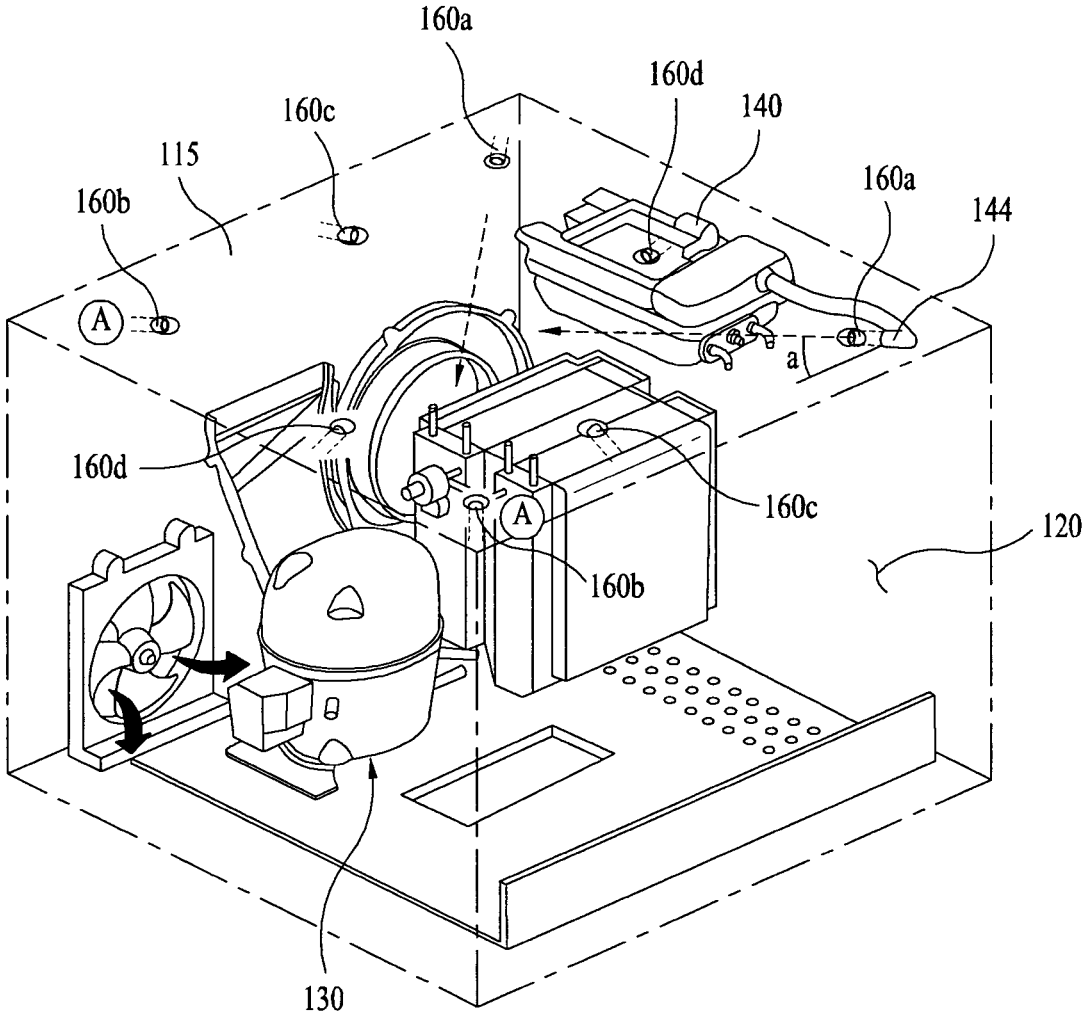
FIGS. 3 and 4 are perspective views illustrating supply units of the clothes treating apparatus.
Figure 4:
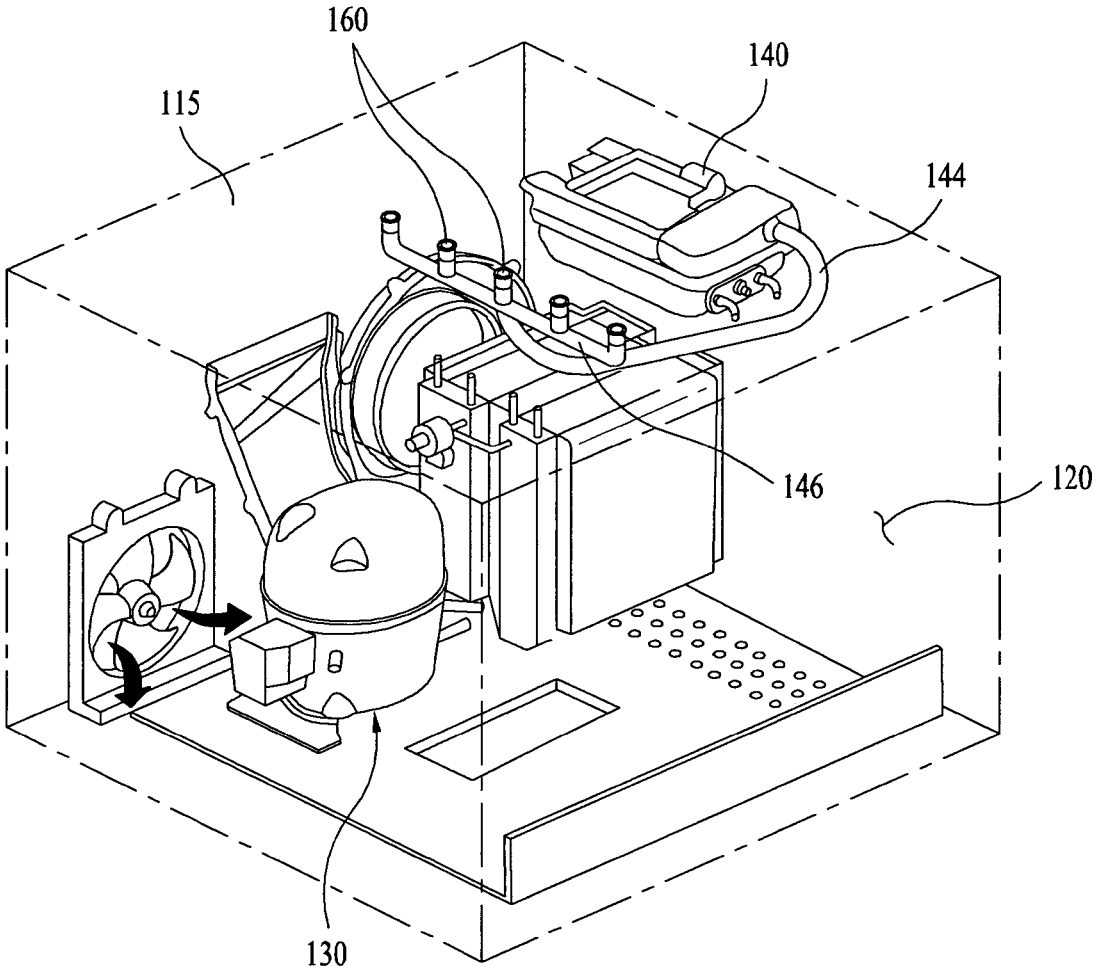

As described above, the supply unit 160 is configured to discharge the moisture generated by the moisture supplying device 140 into the inside of the accommodating space 110. FIGS. 3 and 4 illustrate examples of the supply unit.

The supply unit 160 is basically fitted into the bottom of the accommodating space 110, i.e., the partition 115 or the bottom of the inner cabinet 110*a*. The supply unit 160 discharges the steam, i.e., the moisture, and could comprise a nozzle or a pipe connected to an end of the connection pipe 144. More specifically, the supply unit 160 is inserted into through a hole formed through the bottom of the accommodating space 110, and is not protruded from the bottom of the accommodating space 110. If the supply unit 160 is protruded from the bottom of the accommodating space 110, the supply unit 160 may interfere with the clothes in the accommodating space 110. Further, the protruded supply unit 160 could be seen directly to a user, and thus the external appearance of the clothes treating apparatus is deteriorated. The steam is hot and lighter than air, and thus ascends in the accommodating space 110. In case that the steam is sprayed from the upper portion of the accommodating space 110, the sprayed steam contacts only upper portions of the clothes in the accommodating space 110 while ascending upward. Thus, the steam cannot reach lower portions of the clothes in the accommodating space 110, and the overall clothes cannot be entirely refreshed. However, if the steam is sprayed from the lower portion of the accommodating space 110, the sprayed steam is uniformly distributed in the accommodating space 110, with rising upwardly, and thus reaches the entire clothes. Therefore, as above-described, it is advantageous for effectively refreshing clothes to install the supply units 160 at the bottom of the accommodating space 110.

The supply unit 160 may be provided at the edge of the bottom of the accommodating space 110, as shown in FIG. 3. More specifically, the supply unit 160 may be disposed at the rear portion of the bottom of the accommodating space 110, and in this case, supply unit 160*a* or 160*d* corresponds to the supply unit 160 at the rear portion, as shown in FIG. 3. Further, the supply unit 160 may be disposed at the front portion of the bottom of the accommodating space 110, and in this case, supply unit 160*b* or 160*d* corresponds to the supply unit 160 at the front portion. Finally, the supply unit 160 may be disposed at sides of the bottom of the accommodating space 110, and in this case, supply unit 160*a*, 160*b*, or 160*c* corresponds to the supply unit 160 at the side portion. These supply units 160*a* to 160*d* are disposed at the edge of the bottom of the accommodating space 110, and thus are advantageous to uniformly supply steam. Further, the supply units 160*a* to 160*d* are disposed at the edge of the bottom of the accommodating space 110 so as not to be easily seen by a user, and thus enhance the external appearance of the clothes treating apparatus.

Preferably, the supply unit 160 could be oriented to the central portion of the accommodating space 110. Steam sprayed by the centrally-oriented supply units 160 traverses the central portion of the accommodating space 110, and thus could be uniformly distributed in the accommodating space 110. Further, the supply unit 160 may be oriented to be inclined upward. That is, the supply unit 160 may be inclined upward at a predetermined angle (a) against the bottom of the accommodating space 110. Steam sprayed by such a supply unit 160 crosses the accommodating space 110, and at the same time, flows upward in the accommodating space 110. Thus, such a flow path highly contributes to the uniform diffusion and distribution of the steam, and allows clothes to be effectively refreshed the to the uniform contact of the steam with the clothes.

Generally, steam is liable not to reach corner regions of the accommodating space 110. However, since the supply units 160*a* and 160*b* are located at the corners of the accommodating space 110, they could reduce regions, which the steam cannot reach, compared with other supply units 160*c* and 160*d*. Thus, it is preferable that the supply units 160*a* and 160*b*, which are located at the front and rear corners of the bottom of the accommodating space 110, are provided in the clothes treating apparatus to uniformly distribute the steam. However, when the door is opened, the supply units 160*b* at the front corners are exposed directly to a user. Thus, in order to enhance both the external appearance of the clothes treating apparatus and the distribution of the steam, it is most preferable that the supply units 160*a*, which are disposed at the rear corners of the bottom of the accommodating space 110, are provided. As described above, the supply units 160*a* at the rear corners may be oriented to the central portion of the accommodating space 110. More specifically, the supply units 160*a* at the rear corners are respectively oriented to the opposite front corners (A) of the bottom of the accommodating space 110. That is, the supply units 160*a* are respectively oriented in the diagonal directions of the bottom of the accommodating space 110. Steam sprayed by the supply units 160*a* oriented as such traverses the accommodating space 110 in the diagonal directions, and thus is more uniformly distributed in the accommodating space 110. Further, as described above, since the supply units 160*a* could be oriented to be inclined upward, the steam generated by the supply units 160*a* could flow upward in the accommodating space 110 to obtain uniform dispersion and distribution of the steam.

The clothes treating apparatus may include all of the above-described supply units 160*a* to 160*d*. In this case, the clothes treating apparatus includes a plurality of supply units 160*a* to 160*d* disposed along the edge of the bottom of the accommodating space 110, and thus obtains more uniform dispersion and distribution of steam.

Alternatively, the supply unit 160 may be installed at the central portion of the bottom of the accommodating space 110, as shown in FIG. 4. Since the supply units 160 are installed in the bottom of the accommodating space 10 the same as the above example shown in FIG. 3, steam discharged by the supply unit 160 could be also uniformly distributed in the accommodating space 110. Further, as the steam is discharged from the central portion of the bottom of the accommodating space 110 by the supply unit 160, the rising steam directly contacts clothes to be treated as soon as it is discharged. In case that the flow path of the discharged steam becomes long, the temperature of the steam is lowered and a possibility of condensing the steam into water is increased. However, since the steam discharged from the central portion of the bottom of the accommodating space 110 reaches clothes via a short path, the temperature of the steam is not lowered and the steam is not condensed into water. Thereby, the steam is supplied to the clothes while maintaining a desired quality, and thus effectively refreshes the clothes. Further, the supply unit 160 may be oriented substantially vertically to the bottom of the accommodating space 110. Such a supply unit 160 defines the shortest flow path of steam, and thus effectively refreshes clothes by using the steam with no deterioration of the quality thereof.

Further, as shown in FIG. 4, the clothes treating apparatus could include a plurality of supply units 160 installed at the central portion of the bottom of the accommodating space 110. These supply units 160 uniformly distribute and disperse a large quantity of steam into the accommodating space 110 without deterioration of the quality of the steam. If the supply units 160 are respectively connected to the water tank 141 through a plurality of connection pipes 144, which are separated from each other, the connection pipes 144 respectively form independent flow paths of steam. Thus, the substantially long flow paths between the water tank 141 and the supply units 160 are formed, and the lowering of the temperature of the steam and the condensation of the steam are increased because of travelling the long flow paths. For this reason, the supply units 160 are connected to a single manifold 146, which is connected to the moisture supplying device 140, exactly to the water tank 141, as shown in FIG. 4. That is, the supply units 160 are respectively connected to a plurality of subsidiary pipes 146 branching off from the connection pipe 144 connected to the moisture supplying device 140. With the use of the manifold 146, the length of a flow path between the moisture supplying device 140 and the supply units 160 is minimized, and likewise, the lowering of the temperature of the steam and the condensation of the steam are minimized such that the clothes are effectively refreshes. The manifold 146 may be applied to the supply units 160, as shown in FIG. 3, for the same purpose.

In both supply units, as shown in FIGS. 3 and 4, if the connection pipe 144 has a long length, the temperature of the steam may be lowered while the generated steam flows to the supply units 160 through the connection pipe 144. Further, the steam may be condensed during passing through the connection pipe 144 having a relatively low temperature. For these reasons, the amount of the steam, which is substantially sprayed into the accommodating space, is reduced, and intended functions, i.e., removal of wrinkles, sterilization, etc., are not properly performed. In order to prevent these results, the length of the connection pipe 144 could be minimized. In order to minimize the length of the connection pipe 144, the moisture supplying device 140 could be disposed adjacent to the supply units 160. Since the supply units 160 are installed in the bottom of the accommodating space 110, as described above, the moisture supplying device 140 is installed in the upper portion of the device chamber 120 in order to be adjacent to the bottom of the accommodating space 110, as shown in FIG. 3. Further, if the moisture supplying device 140 is installed adjacent to the central portion of the bottom of the accommodating space 110, the moisture supplying device 140 can be located adjacent to all the supply units 160 of FIGS. 3 and 4. Due to the above-described disposition, the moisture supplying device 140 is located adjacent to the supply units 160, and the length of the connection pipe 144 is reduced. Accordingly, the lowering of the temperature of the steam and the generation of condensed water are prevented, and thus a sufficient amount of the steam is supplied into the accommodating space 110 to effectively treat the clothes.

Further, the connection pipe 144 is preferably made of a synthetic resin (plastic) or rubber rather than a metal. The synthetic resin or rubber has a lower thermal conductivity than that of the metal, and thus suppresses heat exchange of the steam in the connection pipe 144 with external cold air. Therefore, the steam in the connection pipe 144 made of the synthetic resin or rubber is not easily condensed.

As described above, the steam is uniformly distributed and diffused in the accommodating space without deterioration of the quality of the steam due to the proper disposition of the supply units. Thus, the steam contacts the clothes entirely, and the clothes are effectively refreshed. Further, a sufficient amount of the steam is supplied to effectively treat the clothes without the lowering of the temperature of the steam and the generation of condensed water the to the proper disposition of the moisture supplying device.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A clothes treating apparatus comprising:

a cabinet;

an accommodating space formed in the cabinet, and accommodating clothes;

a moisture supplying device generating moisture to be supplied into the accommodating space, wherein the moisture supplying device includes a water tank storing water, and a heater installed in the water tank to heat water;

a plurality of supply units discharging the moisture generated by the moisture supplying device into the accommodating space, and installed at a bottom of the accommodating space; and a connection pipe to connect the supply units and the water tank to transfer the moisture from the water tank to the supply units, wherein the supply units are disposed at an edge of the bottom of the accommodating space, and the supply units are oriented to the central portion of the bottom of the accommodating space and oriented to be inclined upwardly, and wherein the supply units are inserted into holes formed through the bottom of the accommodating space and exposed from the bottom of the accommodating space.

2. The clothes treating apparatus according to claim 1, wherein at least one of the supply units is disposed at a rear, front, or side portion of the bottom of the accommodating space.

3. The clothes treating apparatus according to claim 1, wherein at least one of the supply units is provided at a rear or front corner of the bottom of the accommodating space.

4. A clothes treating apparatus comprising:

a cabinet;

an accommodating space formed in the cabinet, and accommodating clothes;

a moisture supplying device generating moisture to be supplied into the accommodating space; and a plurality of supply units discharging the moisture generated by the moisture supplying device into the accommodating space, and installed at a bottom of the accommodating space, wherein the supply units are disposed at the central portion of the bottom of the accommodating space, and the supply units are connected to a plurality of subsidiary pipes branching off from a connection pipe connected to the moisture supplying device, and wherein the supply units are inserted into holes formed through the bottom of the accommodating space and exposed from the bottom of the accommodating space.

5. The clothes treating apparatus according to claim 4, wherein the supply unit is oriented to be substantially vertical to the bottom of the accommodating space.

6. The clothes treating apparatus according to claim 1, wherein at least one of the supply units comprises a nozzle or a pipe, which is not protruded from the bottom of the accommodating space.

7. The clothes treating apparatus according to claim 1, wherein the moisture supplying device includes a pressurizing unit applying a predetermined pressure to the supplied moisture.

8. The clothes treating apparatus according to claim 1, wherein the connection pipe is made of a synthetic resin or rubber.

9. The clothes treating apparatus according to claim 1, wherein the moisture supplying device is installed adjacent to the bottom of the accommodating space to be located close to the supply unit.

10. The clothes treating apparatus according to claim 1, further comprising an air supplying device supplying dry air into the accommodating space.

* * * * *